US009118116B2

(12) United States Patent
Apostolos et al.

(10) Patent No.: US 9,118,116 B2
(45) Date of Patent: Aug. 25, 2015

(54) COMPACT CYLINDRICALLY SYMMETRIC UHF SATCOM ANTENNA

(71) Applicant: AMI Research & Development, LLC, Windham, NH (US)

(72) Inventors: John T. Apostolos, Lyndeborough, NH (US); William Mouyos, Windham, NH (US); Brian Molen, Windham, NH (US); Benjamin McMahon, Nottingham, NH (US)

(73) Assignee: AMI Research & Development, LLC, Windham, NH (US)

( * ) Notice: Subject to any disclaimer, the term of this patent is extended or adjusted under 35 U.S.C. 154(b) by 0 days.

(21) Appl. No.: 14/102,717

(22) Filed: Dec. 11, 2013

(65) Prior Publication Data

US 2014/0176385 A1 Jun. 26, 2014

Related U.S. Application Data

(60) Provisional application No. 61/736,063, filed on Dec. 12, 2012, provisional application No. 61/782,433, filed on Mar. 14, 2013.

(51) Int. Cl.

| | |
|---|---|
| ***H01Q 1/36*** | (2006.01) |
| ***H01Q 13/12*** | (2006.01) |
| ***H01Q 25/02*** | (2006.01) |
| ***H01Q 21/20*** | (2006.01) |
| ***H01Q 21/24*** | (2006.01) |

(52) U.S. Cl.

CPC ..... *H01Q 1/36* (2013.01); *H01Q 13/12* (2013.01); *H01Q 21/205* (2013.01); *H01Q 21/24* (2013.01); *H01Q 25/02* (2013.01)

(58) Field of Classification Search

CPC ..... H01Q 1/36; H01Q 13/10; H01Q 13/12; H01Q 13/14; H01Q 21/26; H01Q 21/28

USPC ..... 343/725, 767, 770, 797, 798

See application file for complete search history.

(56) References Cited

U.S. PATENT DOCUMENTS

| | | | | |
|---|---|---|---|---|
| 4,051,474 | A * | 9/1977 | Mack et al. | 342/362 |
| 4,121,216 | A | 10/1978 | Bunch et al. | |
| 5,202,697 | A * | 4/1993 | Bonebright et al. | 343/770 |
| 6,373,446 | B2 | 4/2002 | Apostolos | |
| 6,690,331 | B2 | 2/2004 | Apotolos | |
| 6,888,510 | B2 | 5/2005 | Jo et al. | |
| 7,436,369 | B2 | 10/2008 | Apostolos | |
| 7,505,009 | B2 | 3/2009 | Parsche et al. | |
| 7,623,075 | B2 | 11/2009 | Apostolos | |
| 7,852,276 | B2 | 12/2010 | Apostolos | |
| 2004/0090389 | A1 * | 5/2004 | Jo et al. | 343/797 |

FOREIGN PATENT DOCUMENTS

| | | | | |
|---|---|---|---|---|
| WO | WO 2007/073993 A1 * | 7/2007 | | H01Q 13/18 |

* cited by examiner

*Primary Examiner* — Robert Karacsony

(74) *Attorney, Agent, or Firm* — Cesari and McKenna, LLP

(57) ABSTRACT

A cylindrically symmetric satellite antenna that provides directional and omnidirectional operating modes in a compact form factor. Feed points located at the top of the cylindrical structure provide increased platform isolation. Combining networks, disposed below or within the cylindrical structure, may be replaced with inexpensive baluns composed of coaxial line sections.

11 Claims, 9 Drawing Sheets

COMPACT CYLINDRICALLY SYMMETRIC UHF SATCOM ANTENNA

CROSS REFERENCE TO RELATED APPLICATIONS

The present application claims the benefit of U.S. Provisional Patent Application Ser. No. 61/736,063, which was filed on Dec. 12, 2012, by John T. Apostolos et al. for a COMPACT CYLINDRICALLY SYMMETRIC UHF SATCOM ANTENNA and U.S. Provisional Patent Application Ser. No. 61/782,433, which was filed on Mar. 14, 2013, by John T. Apostolos et al. for a COMPACT UHF SATCOM ANTENNA WITH A HEMISPHERICAL CARDIOID PATTERN. The entire contents of the above-referenced patent applications are hereby incorporated by reference.

BACKGROUND

1. Technical Field

This application relates to a compact cylindrical form factor antenna suitable for use in satellite communications and other applications.

2. Background Information

In certain applications of radio communications it is important to be able to robustly communicate without knowing the relative orientation of the transmit and receive antennas in advance. For example, in the case of communication from a satellite to a terrestrial vehicle, as the vehicle moves about the terrain (or even within a building), signals arrive at the antenna on the vehicle with a variety of different polarizations from different directions. If the vehicle uses, for example, a simple vertical dipole, one obtains 360° coverage but only for vertically polarized signals. Such a vertical dipole is relatively insensitive to horizontally polarized signals.

Many antennas mounted on vehicles also take the form of a mast that may be purposely flexible so that if the antenna hits an object it will bend and not snap or break. Antennas formed with flexible masts thus have their vertical and/or horizontal orientation direction altered by the flexibility of the mast, meaning that reliable communication cannot always be established if the polarization direction of the antenna is not exactly aligned with that of the transmitter. In short, it is often the case that as a vehicle moves throughout an environment, its antenna may tilt at various angles and therefore compromise communications with either a terrestrial base station or a satellite.

It is known that an Orientation-Independent Antennas (ORIAN) can be formed from crossed vertical loops in combination with one or more horizontal loops. This arrangement may provide circular polarization in a hemisphere surrounding the antenna such that signals are robustly received regardless of their polarization or angle of arrival. The antenna can be a free standing antenna.

One such ORIAN antenna is in the form of a cube with the various loops implemented as triangular shaped antenna elements disposed on the surfaces of the cube. Such antennas are described in further detail in U.S. patent application Ser. No. 13/404,626 filed on Feb. 24, 2012 by Apostolos, et al. the entire contents of which are hereby incorporated by reference.

SUMMARY

A satellite communications antenna that provides directional and omnidirectional operating modes in a compact cylindrical form factor. Feed points located at the top of the cylindrical structure provide superb performance and increased platform isolation. Combining networks, disposed below or within the cylindrical structure, may be replaced with inexpensive baluns composed of coaxial line sections.

In one embodiment the antenna is provided as four sections or quadrants formed on or formed in the shape of at least one outer curved surface of a cylinder. The top and, optionally, the bottom, of the cylinder may also be a flat conductive surface or metal plate(s) which may themselves be formed as four, generally pie-shaped, triangular conductive elements.

In a preferred arrangement, the antenna structure is fed at the top of the cylinder, at or near an intersection of the four triangular elements. Feedlines coupled to each triangular element connect to a phasing network which is preferably located at the bottom of the cylindrical structure. The phasing network combines the feeds for the four elements to provide Right Hand and/or Left Hand, circularly polarized outputs.

In one embodiment, an omnidirectional metallic radiator may be disposed in the center of the structure. In an embodiment where the centrally located omnidirectional metallic radiator is a hollow metallic cylinder, the feed lines may run down through the centrally located hollow cylinder.

The phasing network may itself take several different forms. In one implementation, the phasing network can be a pair of 180° combiners feeding a 90° combiner. However in other embodiments the phasing network may be provided by a pair of baluns formed of a coaxial cable section with a quarter wavelength electrical shorting section.

In certain other embodiments, mirror image top and bottom cylindrical sections are utilized to create a cardioid hemispherical radiation pattern. In this embodiment, each cylindrical section is embodied as the four antenna element sections or quadrants formed on or formed in at least one surface of a respective cylinder. The top and, optionally, the bottom, of each cylindrical section may also be a conductive surface which may comprise four pie-shaped conductive elements. In a preferred arrangement, these antenna elements are fed at the intersection of the four triangles to provide a crossed bowtie arrangement via feedlines that connect to a phasing network, as in the other embodiment already discussed.

A feed network interconnects the minor image top and bottom cylindrical sections to form a cardioid hemispherical pattern. The resulting radiation pattern and resulting gains are substantially independent of height of the antenna over a ground plane. This makes it possible to facilitate installation of the antenna in a desired location, such as the top of a vehicle, with less concern about the orientation with respect to other metal surfaces of the vehicle which might otherwise represent interfering ground planes.

BRIEF DESCRIPTION OF THE DRAWINGS

The description below refers to the accompanying drawings, of which.

DETAILED DESCRIPTION OF AN ILLUSTRATIVE EMBODIMENT

Figure 1:
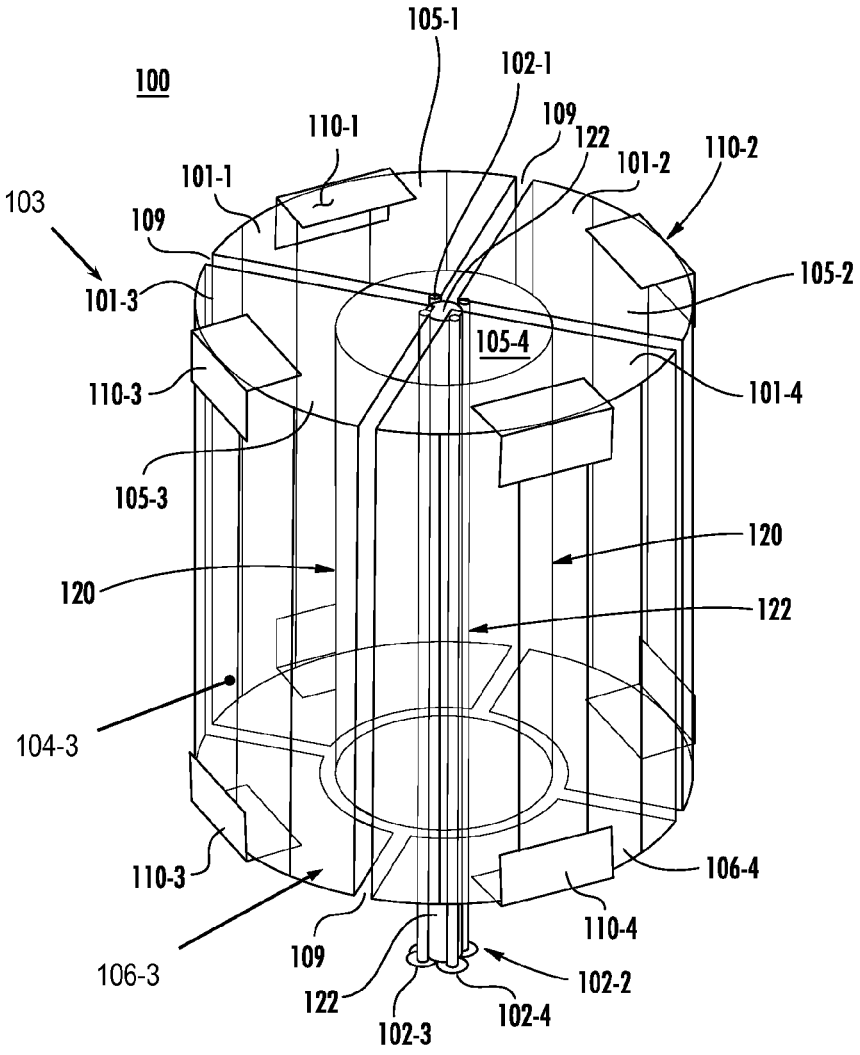
FIG. 1 is a transparent three dimensional view of the antenna structure.

FIG. 1 is a three dimensional view of a Satellite Communications (SATCOM) antenna structure 100 with various surfaces rendered in transparency to show certain details within.

The antenna 100 consists of a directional portion comprising four radiating quadrant sectors 101-1, 101-2, 101-3, 101-4 (collectively referred to as the quadrants 101) fed at the top by four corresponding coaxial feedlines 102-1, 102-2, 102-3, 102-4 (collectively, the feedlines 102). Each quadrant 101 includes a section of a cylinder 103. Each quadrant 101 also preferably consists of one or more conductive radiating elements on the exterior surface of the cylinder 103. Note that interruptions 109 in the conductive surfaces, or corresponding dielectric, non-conductive portions, define and separate the four quadrant elements 101 from one another.

The radiating surface elements in an example quadrant 101-3 include at least the corresponding conductive surfaces on the curved side 104-3 and top 105-3 of the cylinder 103. In another embodiment, the radiating elements in one or more of the quadrants 101 also include a radiating surface 106-3 located on the bottom of the cylinder 103 as well. The resulting top 105-3 and, if present bottom 106-3, surface elements are generally triangular, e.g., pie-shaped.

The radiating elements 104, 105, 106 in each quadrant 101 may be coupled to one another via one or more capacitive sections 110.

The four feed lines 102 are routed from a top connecting point 112 down a middle portion of the cylinder 103, as shown in FIG. 1. Routing in this way minimizes effects on performance, since induced currents on the feed lines 102 from the SATCOM radiating sections 104, 105, 106 are cancelled.

The cylindrical form factor is consistent with providing a good omni directional pattern, while the feed point location 112 at the top of the structure minimizes platform interactions that may otherwise affect performance of the antenna 100.

An embedded monopole element 120 can optionally be also placed in the center of the structure. The location is preferably in the center thereof, symmetrically located with a primary axis of cylinder 103. This location results in minimum interaction between the omnidirectional monopole element 120 and the directional SATCOM antenna elements 104, 105, 106 located on the or in the cylinder 103. Induced currents on the monopole 120 from the SATCOM cylindrical sections also tend to be cancelled in this arrangement.

When the radiating elements 106 are not present on the bottom of the cylinder 103, higher efficiency at the top end of the radio frequency band of interest may be achieved.

Placing this structure 100 over a ground plane (not shown) may also improve its Voltage Standing Wave Ratio (VSWR).

The monopole element 120 may be a metallic, hollow cylinder 122 of a smaller diameter than cylinder 103. In this arrangement, feed lines 102 are preferably run down from their location point 112 near the top of cylinder 103 to the bottom. A support 122, which may be a fiberglass or other dielectric pole, may provide physical support for one or more of the feed lines 102, the cylinder 103, and the embedded element 120.

Figure 2:
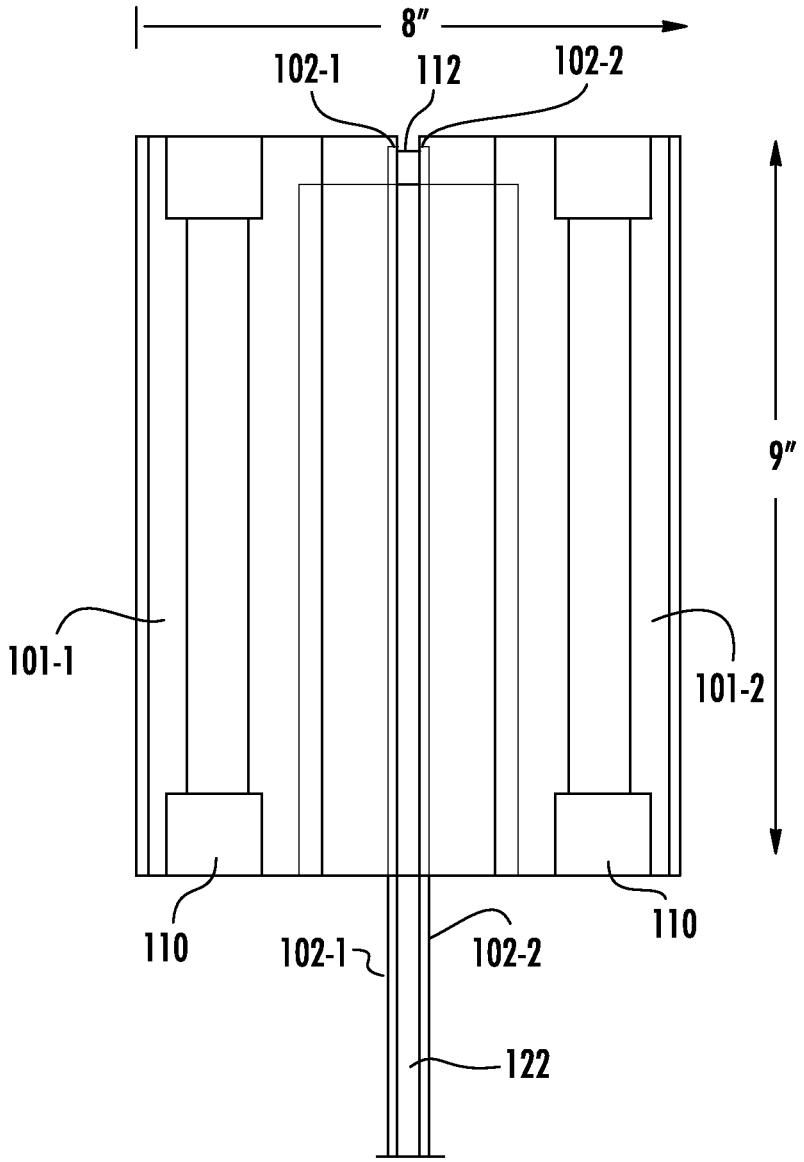
FIG. 2 is a side view of the antenna structure.

FIG. 2 is a side view of the structure showing approximate dimensions for operating in the Ultra-High Frequency (UHF) band, the cylinder 103 being approximately 8" wide and 9" tall.

Figure 3B:
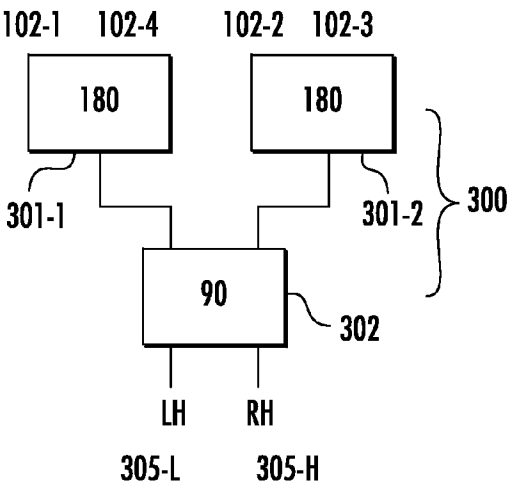
FIG. 3B is a circuit diagram of a combining network.
Figure 3A:
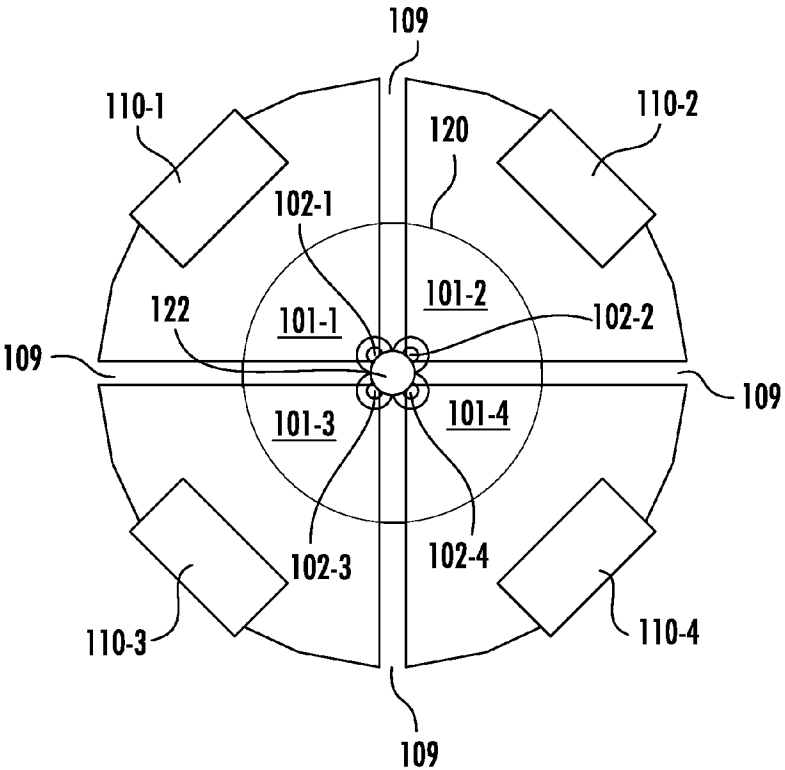
FIG. 3A is a top view.

The coaxial feedlines are connected as shown in the top view of FIG. 3A. The conductors 102-1, 102-2, 102-3, 102-4 are connected to the top plates 101-1, 101-2, 101-3, 101-4 at corresponding points near the center of the structure. The shield and inner conductors of the coaxial cables may be as arranged as will be discussed in more detail below.

At the bottom of the structure the feed lines 102 can be connected to a combining network 300. The combining network, in one embodiment, consists of a pair of 180 degree hybrid combiners 301-1, 301-2 feeding a 90 degree hybrid combiner 302 as shown in FIG. 3B. This combining network 300 provides Left Hand (LH) 305-L and Right Hand (RH) 305-H circularly polarized (C-POL) feed points; other types of combining networks can be used to produce other types of directional and/or polarized signals. For example, a monopole pattern may be derived from the directional elements by feeding the sum ports of the 180 hybrids into a combiner (not shown). A switch controlled by decision logic (also not shown) can permit selection of one of these directional operating modes, such as for example, by selecting the mode that produces the highest received power at a given time.

The hybrids of FIG. 3B can be replaced by ferrite baluns. In particular, a more cost effective method of feeding the antenna structure replaces the four coaxial feedlines and combining network with orthogonal transmission line baluns. One balun is connected between feed points 102-1 and 102-4 and another balun is connected between feed points 102-2 and 102-3.

Figure 4:
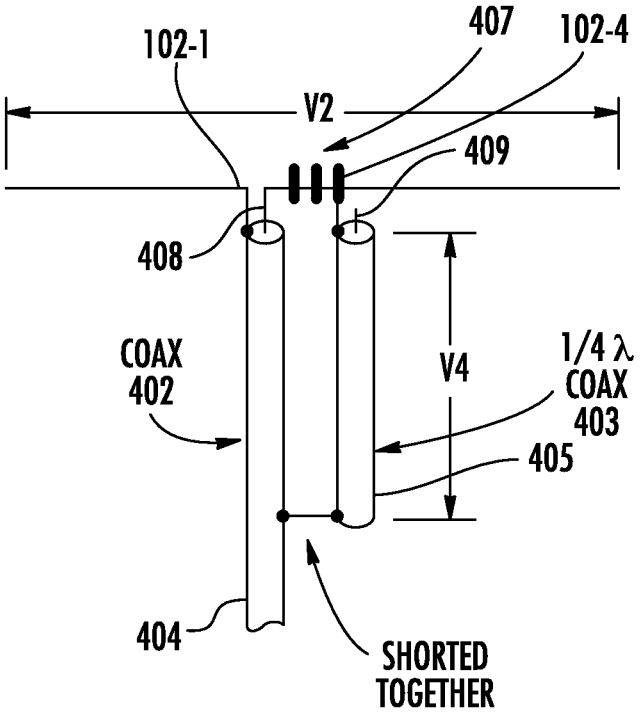
FIG. 4 is a circuit diagram for an example balun used as part of a combining network.

FIG. 4 shows a circuit diagram for an example balun 400 connected between feed points 102-1 and 102-4 in more detail. The balun 400 can be formed from a primary coax section 402 (shown to the left) and a quarter-wavelength coax section 403 (shown to the right). The quarter-wavelength section 403 is used as a short to create the balun 400, by coupling the shields 404, 405 of the two coax sections 402, 403 together. Feed point 102-1 is connected to the shield 404 of the primary coax 402, and feed point 102-4 is connected to the shield 405 of the quarter wavelength coax 403. A coupling capacitance 407 is connected between the center conductor 408 of the primary coax and the shield 405 of the quarter-wavelength coax 403. FIG. 4 illustrates using a single balun 400 for a pair of crossed bow tie type elements 102-1 and 102-4; it is understood that another balun is connected to feed points 102-2 and 102-3, to provide a second pair of crossed bow tie type elements.

Figure 5:
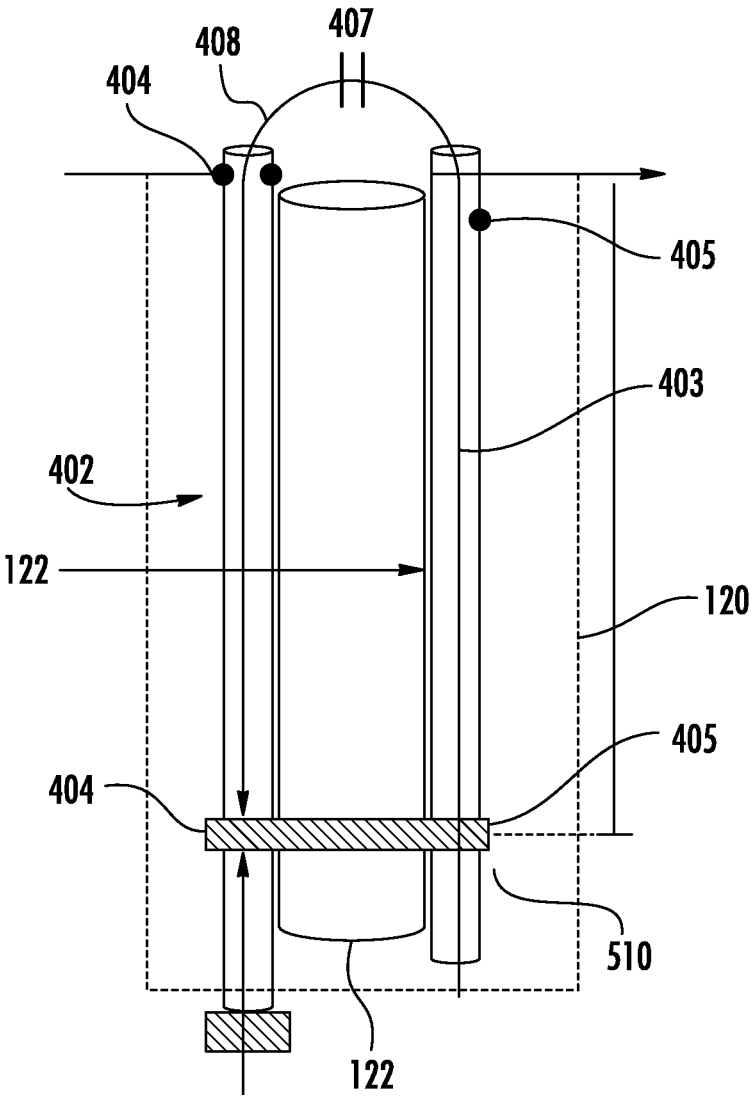
FIG. 5 is a cross sectional view of one possible mechanical arrangement for part of a combining network.

FIG. 5 illustrates a possible mechanical implementation of the balun 400 in more detail. A support structure may be provided by a fiberglass tube 122 onto which the two coax sections 402, 403 are mounted, 180 degrees apart. Tape, glue or other fasteners can hold the coax sections 402, 403 in place. Note feedpoint 102-1 is connected to both the center conductor and the shield of the primary coax section, and feed point 102-4 is connected only to the shield of the quarter-wavelength section, with the center conductor not used (as per FIG. 4). The capacitance 407 is connected between the center conductor of the primary coax and the shield of the quarter-wavelength section. A good short between the outer conductors of the two sections 404, 405 can be provided by a copper ring 510 surrounding the two coax sections.

Shown with the dashed lines is an outer shield cylinder 120 into which the balun assembly may be placed. This reduces sensitivity to the surrounding antenna components providing greater symmetry in operation. The shield 120 may also operate as a monopole element.

Figure 6B:
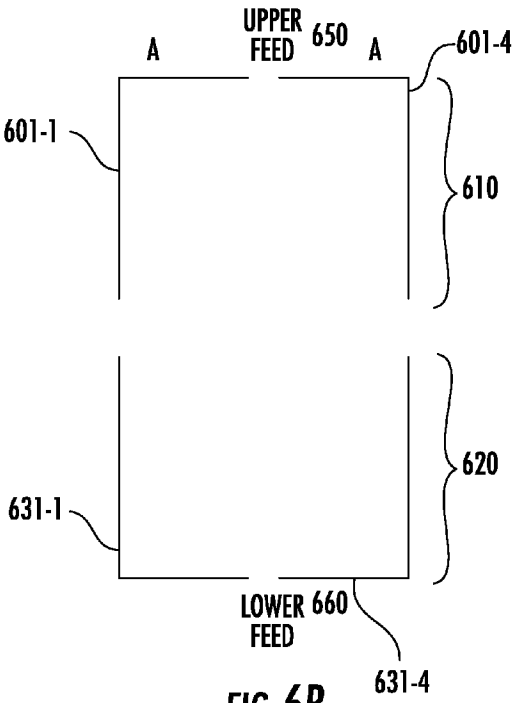
FIG. 6B is a cross sectional schematic view of the same.
Figure 6A:
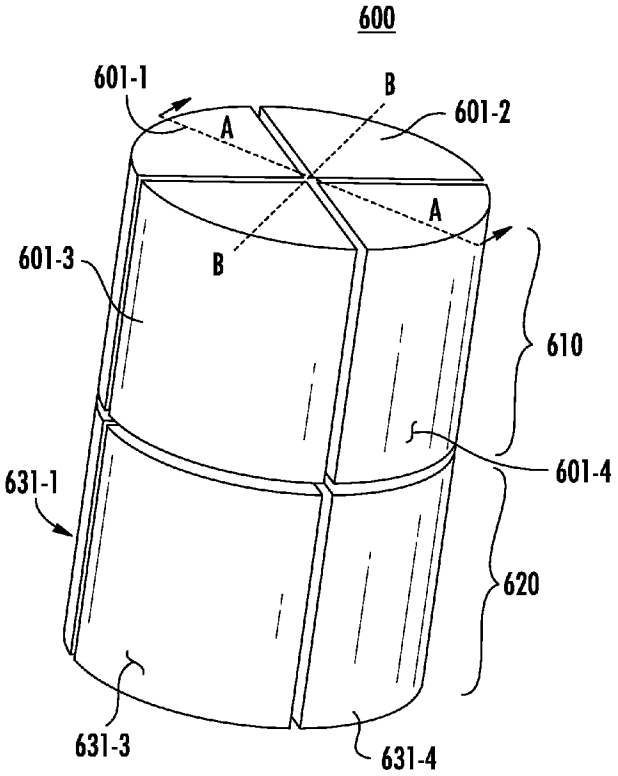
FIG. 6A is a three dimensional view of another embodiment of the antenna structure.

FIG. 6A is a three dimensional view of an alternate embodiment of a Satellite Communications (SATCOM) antenna 600. In this embodiment, the antenna 600 consists of two primary cylindrical sections that are mirror images of one another, including an upper cylindrical section 610 and its minor image, a lower cylindrical section 620.

Each cylinder 610, 620 in this embodiment may be similar in construction and operation to cylinder 100 of FIG. 1. Each cylinder section 610, 620 is thus composed of four radiating quadrants or sectors 601, 631. Each quadrant consists of one or more conductive radiating elements. As with the FIG. 1 embodiment, the cylinders may be metallic or preferably a dielectric with conductive elements form on, in, or near the outer surface(s) of the dielectric cylinder(s). The radiating surface elements in each quadrant include at least the corresponding conductive surfaces on the side and outer surface (top or bottom, respectively). The radiating quadrant elements may be coupled to one another via capacitive sections (not shown).

The four radiating quadrant sectors or elements in each cylinder 610, 620 may be fed at an intersection by four coaxial feedlines in a folded crossed bowtie arrangement as for cylinder 100. The result is an orthogonal, stacked, minor image bowtie arrangement.

As with the FIG. 1 embodiment, the four feed lines from the upper section 610 may be routed from connecting point(s) "down" the center of the cylinder 610 (not shown). Similarly, the four feed lines from lower section 620 may be routed "up" the center of cylinder 620. Routing in this way minimizes effects on performance, since currents induced on the transmission lines from the radiating elements are cancelled.

FIG. 6B is a cross sectional view of the antenna 600 (taken along lines A-A of FIG. 6A) and show the preferred location of upper feed points 650 and lower feed points 660. It should be understood that a first pair of upper and lower crossed bow tie elements (601-1, 604-1 and 631-1, 631-4) lie along the axis defined by line A-A; and an orthogonal pair of upper and lower bow tie elements (601-2, 601-3 and 631-2, 631-3) lie along the axis defined by line B-B.

=The feed systems 650, 660 applied to the two sections 610, 620 should be identical to one another. To create a wideband bottom side null, the lower feed excitation 650 point should have a phase relative to the upper feed 660 point of 180 degrees plus any free space phase shift between the upper element phase center and the lower element phase center.

Figure 7B:
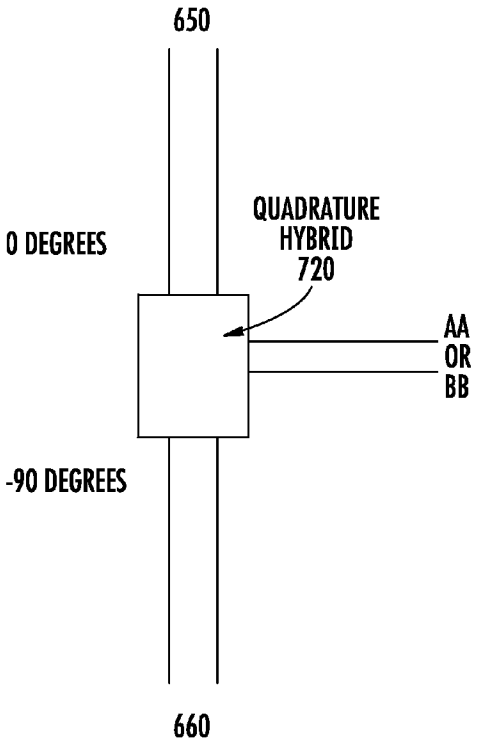
FIGS. 7A, 7B, 7C and 7D show various possible feed arrangements.
Figure 7A:
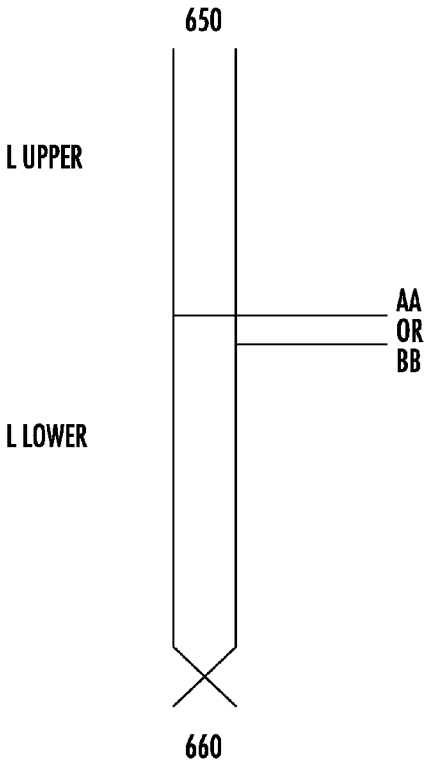

FIG. 7A is one example feed system using only transmission lines; FIG. 7B is another using a quadrature hybrid 720. The FIG. 7B embodiment is usable where bandwidth requirements are modest (that is, if the effective spacing of the upper 610 and lower 620 elements are quarter wave at midband). The various transmission line sections in both the FIG. 7A and FIG. 7B cases may be ferrite loaded coaxial cable. In order not to disturb the symmetry of the antenna 600, the transmission lines should be centered on the axis of symmetry.

The transmission line only configuration of FIG. 7A is somewhat more complicated in that the phase shift caused by the transmission lines (L lower-L upper) must equal a free space phase shift between the centers of the upper and lower elements.

In the FIG. 7B embodiment, the two transmission lines from each orthogonal bow tie feed a quadrature hybrid 720 to generate right hand circular polarization.

Figure 7C:
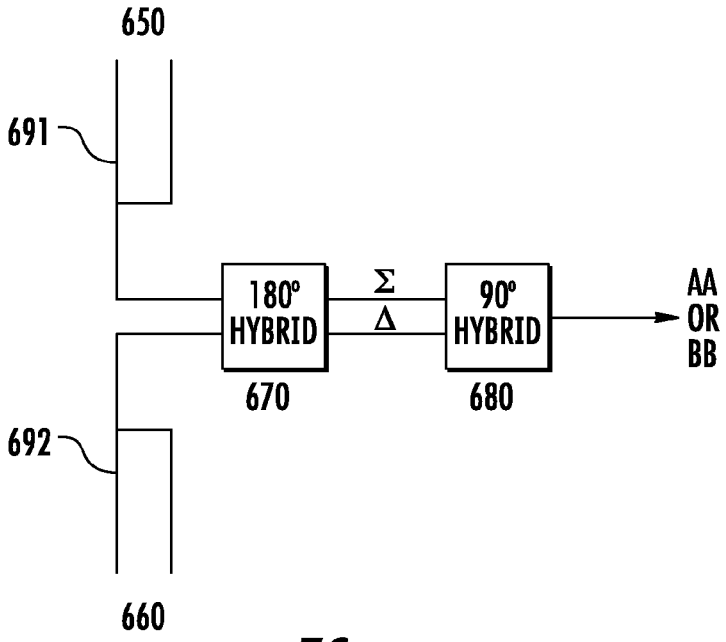

FIG. 7C shows a third embodiment employing a 180 degree hybrid 670, with a 90 degree hybrid 680 combining the sum and difference ports of the 180 hybrid 670 to generate a wideband cardioid pattern for a first bow tie element pair AA (it being understood that an identical hybrid arrangement would be provided for the orthogonal bow tie element pair BB). The transmission line sections 691, 692 may be the baluns of FIGS. 4 and 5; although ferrite loaded coaxial cable may also be used.

Figure 7D:
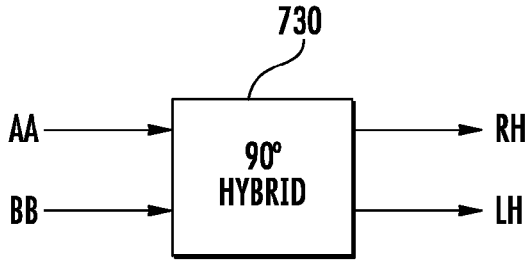

In the feed embodiment of FIG. 7D, the two transmission line sections from from each orthogonal bow tie (as identified by lines AA and BB in FIG. 6A) feed a quadrature hybrid 730 to generate right hand and left hand polarization outputs.

Figure 8:
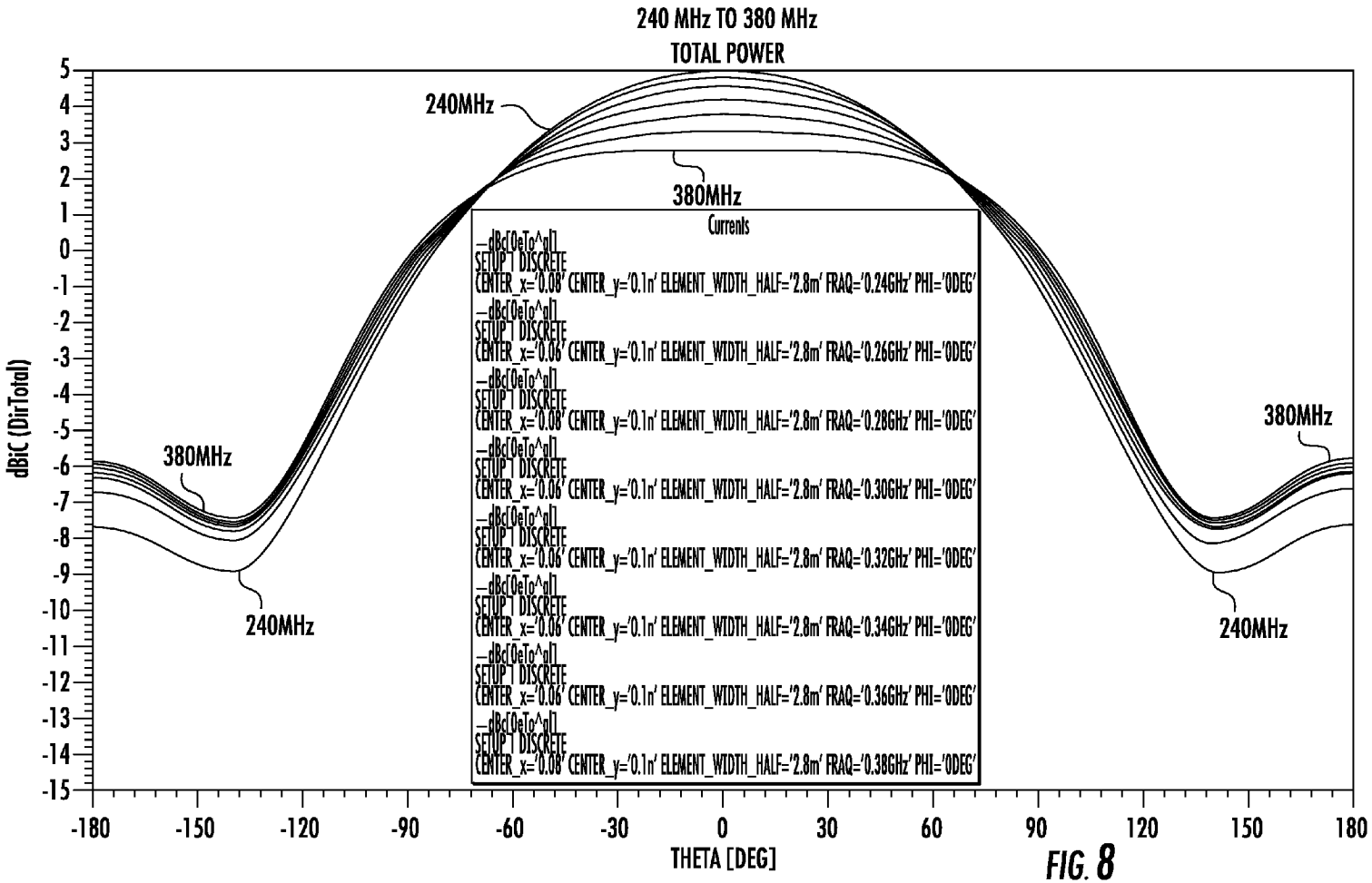
FIG. 8 is a simulated radiation pattern.

Results of a simulation of the antenna using the feed system of FIG. 7C are shown in FIG. 8. The resulting antenna pattern and gain are illustrated to be substantially independent of height above any ground plane disposed beneath the structure—in otherwords, the front lobe response shows robust gain of about 6 dbiC, with the back lobe attenuation being relatively strong (at least approximately 7 dbiC.

It should be understood that the purpose of the Detailed Description of an Illustrative Embodiment is intended to discuss one or more possible implementations without intending to be a restrictive or exhaustive presentation of all possible embodiments of the invention sought to be protected by this patent application. It is therefore understood that the intention here is that the invention is defined by the claims that follow, and is not to be restricted by specific embodiments discussed above.

The invention claimed is:

1. An antenna apparatus comprising:

four quadrant elements, each quadrant element comprising a conductive cylinder side section, a conductive cylinder top section, and a feed point;

a first pair of the four quadrant elements positioned opposite to one another along a major axis;

a second pair of the four quadrant elements positioned opposite to one another along the major axis;

one or more capacitive elements interconnecting the conductive side section and the conductive top section of one or more of the quadrant elements;

a phasing module for selectively combining the feed points provided by respective quadrant elements;

an omnidirectional metallic radiator disposed adjacent the primary axis;

wherein the omnidirectional metallic radiator is a hollow metallic cylinder, and wherein one or more feed lines coupled to corresponding feed points are fed through the hollow metallic cylinder.

2. The apparatus of claim 1 wherein the phasing module provides at least two different polarization modes.

3. The apparatus of claim 2 wherein the two different polarization modes are right hand circular and left hand circular polarization modes.

4. The apparatus of claim 1 additionally wherein at least one quadrant element further comprises a conductive cylinder bottom section.

5. The apparatus of claim 1 wherein the conductive cylinder top sections further each comprise a flat conductive surface having a pie-shape and are disposed in a common plane with the other conductive cylinder top sections.

6. The apparatus of claim 1 additionally comprising:

four feed lines, each feed line coupled to corresponding one of the feed points, the feed lines further arranged to be disposed along the primary axis.

7. The apparatus of claim 1 wherein the phasing network further comprises a pair of 180° combiners feeding a 90° combiner.

8. The apparatus of claim 1 wherein the phasing network further comprises a pair of baluns, each balun formed of a coaxial cable section and a quarter wavelength electrical shorting section.

9. An antenna apparatus comprising:

four quadrant elements, each quadrant element comprising a conductive cylinder side section, a conductive cylinder top section, and a feed point;

a first pair of the four quadrant elements positioned opposite to one another along a major axis;

a second pair of the four quadrant elements positioned opposite to one another along the major axis;

one or more capacitive elements interconnecting the conductive side section and the conductive top section of one or more of the quadrant elements;

a phasing module for selectively combining the feed points provided by respective quadrant elements; and wherein the four quadrant elements comprise a first cylindrical antenna subassembly and wherein the apparatus additional comprises:

a second cylindrical antenna subassembly configured as a mirror image of the first cylindrical antenna subassembly, the second cylindrical subassembly comprising:

four quadrant elements, each quadrant element comprising a conductive cylinder side section, a conductive cylinder top section, and a feed point;

a third pair of the four quadrant elements positioned opposite to one another along a major axis;

a fourth pair of the four quadrant elements positioned opposite to one another along the major axis;

one or more capacitive elements interconnecting the conductive side section and the conductive top section of one or more of the third or fourth pair of quadrant elements; and a phasing module for selectively combining the feed points provided by respective ones of the third and/or fourth pair of quadrant elements.

10. The apparatus of claim 9 wherein the omnidirectional metallic radiator is a hollow metal cylinder disposed adjacent the primary axis.

11. The apparatus of claim 10 wherein one or more feed lines coupled to corresponding feed points are fed through the hollow metallic cylinder.

* * * * *

UNITED STATES PATENT AND TRADEMARK OFFICE

CERTIFICATE OF CORRECTION

PATENT NO. : 9,118,116 B2
APPLICATION NO. : 14/102717
DATED : August 25, 2015
INVENTOR(S) : Apostolos et al.

It is certified that error appears in the above-identified patent and that said Letters Patent is hereby corrected as shown below:

In the Specification:
Col. 2, line 42 should read:
A feed network interconnects the mirror image top and Col. 5, line 3 should read:
mirror image, a lower cylindrical section 620.

Col. 5, line 20 should read:
inder 100. The result is an orthogonal, stacked, mirror image Signed and Sealed this
Twelfth Day of January, 2016

Michelle K. Lee

Michelle K. Lee
*Director of the United States Patent and Trademark Office*